US006404999B1

(12) United States Patent
Shoji et al.

(10) Patent No.: US 6,404,999 B1
(45) Date of Patent: Jun. 11, 2002

(54) IMAGE FORMATION APPARATUS WITH DETERMINATION OF STATE OF TRANSFER DEVICE

(75) Inventors: Junichi Shoji, Kanasagou-machi; Satoshi Narita, Hitachiota; Tetsunori Kaneko, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/685,879

(22) Filed: Oct. 11, 2000

(30) Foreign Application Priority Data

Oct. 15, 1999 (JP) ..... 11-293407

(51) Int. Cl.[7] ..... G03G 15/00
(52) U.S. Cl. ..... 399/66; 399/18; 399/314
(58) Field of Search ..... 399/66, 18, 297, 399/310, 313, 314

(56) References Cited

FOREIGN PATENT DOCUMENTS

JP 8-220902 A * 8/1996
JP 8-292666 A * 11/1996
JP 8-314290 A * 11/1996
JP 10-39576 A * 2/1998
JP 10-186785 A * 7/1998
JP 11-237814 8/1999
JP 2000056635 A * 2/2000

* cited by examiner

*Primary Examiner*—Quana M. Grainger
(74) *Attorney, Agent, or Firm*—Antonelli, Terry, Stout & Kraus, LLP

(57) ABSTRACT

An image forming apparatus including an image forming device on which toner images are formed; a transfer device for transferring the toner images onto a record medium; a voltage-application unit for applying a transfer voltage to the transfer device; a current-detection unit for detecting current flowing between the image forming device and the transfer device; a storage unit for storing a first current value detected at a non-operation position of the transfer device, and a second current value detected at an operation position of the transfer device; and a transfer device state-determination unit for determining the presence of the transfer device and the occurrence of an anomaly in a contact operation of the transfer device with the image forming device and a shunt operation in which the transfer device is moved away from the image forming device.

19 Claims, 4 Drawing Sheets

IMAGE FORMATION APPARATUS WITH DETERMINATION OF STATE OF TRANSFER DEVICE

BACKGROUND OF THE INVENTION

The present invention relates to an image forming apparatus, and, especially, to an image forming apparatus which is suitable for detecting an anomaly in an attachment state or in a shunt operation of a transfer device, which transfers a color image from an intermediate transfer device onto a record medium.

The conventional apparatuses, such as the apparatus disclosed in Japanese Patent Application Laid-Open Hei 11-237814, are composed of a photoconductor, a transfer device for transferring a toner image formed on the photoconductor onto a record medium, a power supply for applying a voltage to the transfer device, a current detector for detecting current flowing in the transfer means, a voltage-control means for controlling the voltage of the power supply based on the current detected by the current detector, and a determination means for determining the presence of the photoconductor based on the current detected by the current detector.

Although the above-disclosed conventional apparatus uses a technique which detects whether or not the photoconductor is actually attached in the color image forming apparatus, it cannot detect the presence of a transfer device which is moved to a shunt position during a period when a color image is being formed on an intermediate transfer device by superimposing toner images thereon, and is put in contact with the intermediate transfer device during a period when the color image on the intermediate transfer device is transferred by the transfer device onto a record medium. Further, it is impossible to detect an anomaly in the switching operation involving the movement of the transfer device to the shunt position and to the contact position with the intermediate transfer device.

Further, there has been a problem in which the reliability of detection of an anomaly in the movement of a transfer device is generally low, because the value of current flowing in the transfer device changes depending on temperature and humidity in the environment in which the image forming apparatus, including the transfer device, is located.

SUMMARY OF THE INVENTION

An object of the present invention is to provide an image forming apparatus which can detect an erroneous attachment of a transfer device, which is likely to occur at the time of replacement of the transfer device, during inspection and maintenance work, or which can detect an anomaly in the switching operation involving movement of the transfer device between the shunt position and the position in contact with the intermediate transfer device.

Also, another object of the present invention is to provide a color image forming apparatus which can detect an anomaly of a transfer device with high accuracy by preventing an erroneous anomaly-detection due to changes in conditions of the environment in which the image forming apparatus, including the transfer device, is located.

To achieve the above objects, the present invention provides an image forming apparatus comprising an image forming device on which toner images are formed; a transfer device for transferring the toner images onto a record medium; a voltage-application means for applying a transfer voltage to the transfer device; a current-detection means for detecting current flowing between the image forming device and the transfer device; a storage means for storing a first current value detected when the transfer device is at a non-operation position, and a second current value detected when the transfer device is at an operation position; and a state-determination means for determining the presence of the transfer device and an occurrence of an anomaly in the contact of the transfer device with the image forming device and in a shunt operation in which the transfer device is displaced from the image forming device.

The image forming apparatus further includes a photoconductor on which electrostatic latent images are formed, and a development device for developing the latent images; wherein the image forming device is an intermediate transfer device onto which the images developed on the photoconductor are transferred.

Also, in the image forming apparatus, the respective images formed on the photoconductor are developed with toners of different colors, and the images developed with the toners of different colors arc superimposed on the intermediate transfer device.

Furthermore, in the image forming apparatus, the transfer device is moved into contact with and is separated from the intermediate transfer device, and the first current value, which is detected when the transfer device is at a position spaced from the intermediate transfer device, is stored in the storage means.

Still further, in the image forming apparatus, the second current value, which is detected after a control command signal operates to move the transfer device into contact with the intermediate transfer device, is stored in the storage means, and the state-determination means determines the presence of the transfer device. The occurrence of an anomaly in the contact of the transfer device with the image forming device, and in the movement of the transfer device to a shunt position away from the image forming device, is detected based on the stored first and second current values.

In addition, in the image forming apparatus, the occurrence of anomaly is detected by the state-determination means by comparing a current difference between the first and second current values with a predetermined reference value.

Also, in the image forming apparatus, the respective first and second current values are detected multiple times, and an average of current difference values, obtained with these first and second current values, is used as the reference value.

Further, in the image forming apparatus, each current difference value, obtained at every determination executed by the state-determination means, which has been determined to be normal, is stored in the storage means, and the reference value is set or corrected using a statistic value, which is obtained by statistically processing the history of die stored current difference values.

Moreover, the present invention provides a color image-forming apparatus comprising a photoconductor on which electrostatic latent images are formed by charging and exposing the photoconductor, and on which toner images of the latent images are formed by developing the latent images; an intermediate transfer device, which partially contacts the photoconductor, for receiving a first transfer of each of the toner images on the photoconductor, for each color, on its surface while moving endlessly; a control means for forming a color image by causing the toner images of plural colors to be superimposed on the intermediate transfer device; a transfer device for performing a second transfer of the color image onto a record medium; a transfer device contact/shunt operations-switching mechanism for placing the transfer device in a non-contact state with respect to the intermediate transfer device by moving the transfer device to a predetermined shunt position away from the intermediate transfer device during a color image-forming period, and for causing the transfer device to be pressed against the intermediate transfer device via a record medium after the completion of color image-formation; a power-supply means for changing and applying a transfer voltage to the transfer device when the color image is transferred from the intermediate transfer device onto the record medium; a current-detection means for detecting current between the transfer device and the intermediate transfer device; a transfer voltage-setting means for setting up the transfer voltage based on the detected current; and a transfer state-determination means for determining the presence and attachment state of the transfer device, and the occurrence of an anomaly in the contact of the transfer device with the image forming device and in the movement of the transfer device from the image forming device to the shunt position, based on the stored first and second current values.

Further, in the color image-forming apparatus, a first current value is detected by the current-detection means when the transfer device is pressed on the intermediate transfer device without the intervention of a record medium during a non-transfer period of the transfer, and a second current value is detected by the current-detection means when the transfer device is in a non-contact state in which the transfer device is located at a predetermined position away from the intermediate transfer device.

Also, in the color image-forming apparatus, the state-detection means determines the presence and attachment state of the transfer device, and the occurrence of an anomaly in the contact of the transfer device with the image forming device and in the movement of the transfer device to a shunt position away from the image forming device, based on a current difference between the first and second current values.

To achieve the above object, the present invention also provides a method of determining an anomalous state of a transfer device in an image forming apparatus including an image forming device on which toner images are formed, a transfer device for transferring the toner images onto a record medium, a voltage-application means for applying a transfer voltage to the transfer device, a current-detection means for detecting current flowing between the image forming device and the transfer device, and a storage means for storing values of the detected current, the method comprising the steps of: applying a predetermined voltage to the transfer device after it is confirmed that a command signal for operating the image forming apparatus has been output; detecting a first current flowing between the transfer device and the image forming device at least one time; storing a value of the detected first current in the storage means; pressing the transfer device against the image forming device; detecting a second current flowing between the transfer device and the image forming device at least one time; storing a value of the detected second current in the storage means; calculating a difference between the values of the detected first current and second current; comparing the difference with a predetermined reference value; and determining that the transfer device is in an anomalous state, if the difference is smaller than the predetermined reference value.

Further, in the above method, the respective first and second current values are detected plural times, and an average of current difference values obtained with these first and second current values is used as the reference value.

Furthermore, in the above method, each current difference value obtained at every determination executed by the transfer device state-determination means, which has been determined to be normal, is stored in the storage means, and the reference value is set or corrected using a statistic value, which is obtained by statistically processing the history of the stored current difference values.

BRIEF DESCRIPTION OF THE DRAWINGS

FIG. 3 is a flow chart showing another example of the process for determining the occurrence of an anomaly of a transfer device, which is executed in the embodiment, in which the occurrence of an anomaly is determined at the time a power supply is turned on.

DETAILED DESCRIPTION OF THE EMBODIMENTS

Hereafter, the embodiments will be explained in detail with reference to the drawings.

Figure 1:
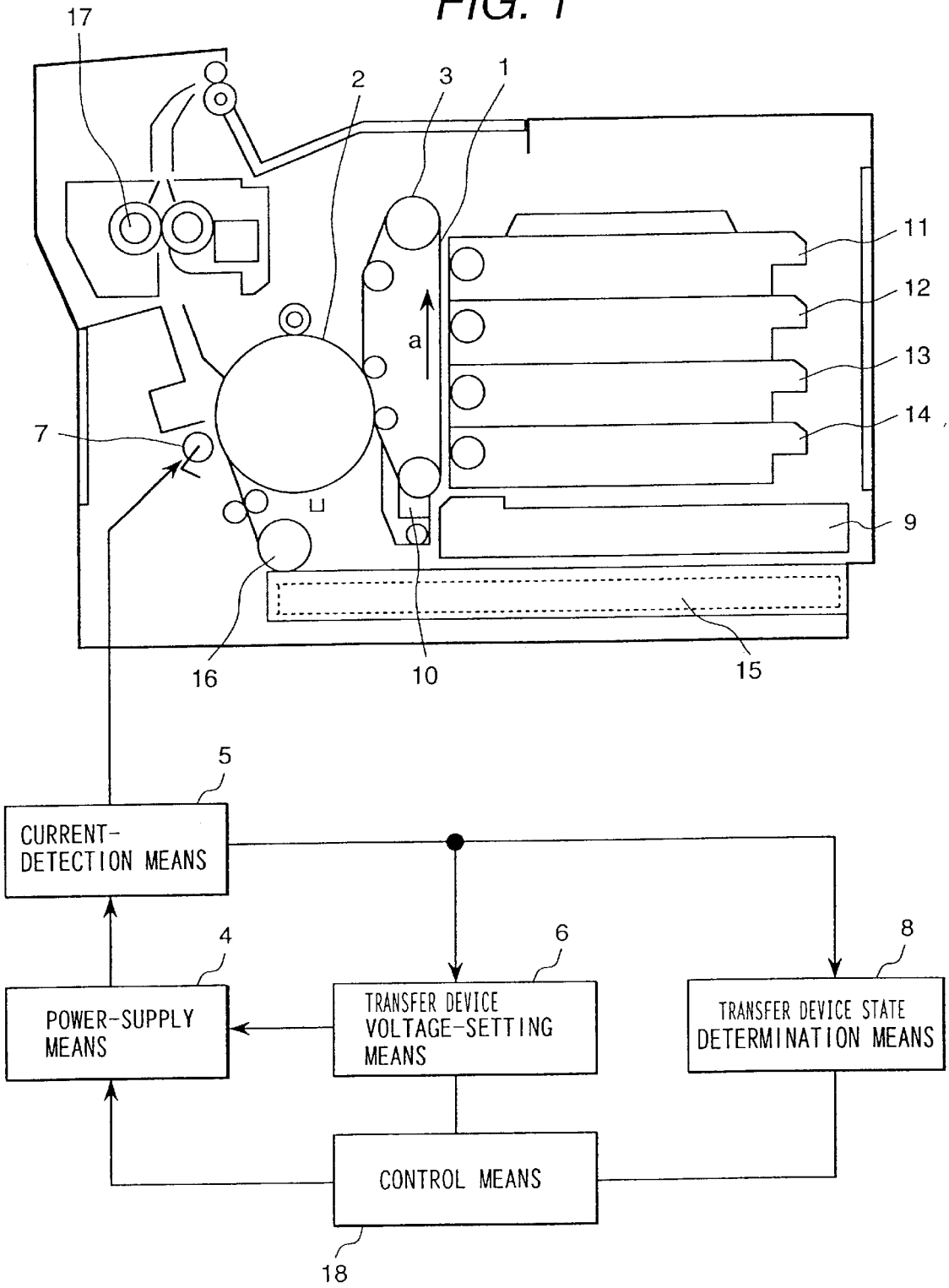
FIG. 1 is a side vertical cross section of a color image forming apparatus representing an embodiment according to the present invention.

FIG. 1 is a schematic side vertical cross-sectional diagram showing the composition of a color image forming apparatus representing an embodiment according to the present invention.

The color image forming apparatus shown in FIG. 1 includes an intermediate transfer device 2 in the form of a transfer drum, and a photoconductor 1 in the form of a photoconductive belt on which an electrostatic latent image is formed by charging and exposing the photoconductor 1, and on which a toner image of each color is formed by developing the electrostatic latent image. The intermediate transfer device 2 partially contacts the photoconductor 1 for effecting transfer of a toner image of each color onto its surface while rotating; and a drive means 3 is provided for driving the photoconductor 1, which applies a driving force to the intermediate transfer device 2 via contact with the photoconductor 1. Further, this apparatus includes a control means 18 which controls a series of operations to form the color image by superimposing the toner images of multiple colors; and a power supply means 4 for adjusting and feeding a transfer voltage to a transfer device 7 to transfer the color image from the intermediate transfer device 2 onto a record medium. The transfer device (transfer roller) 7, for performing the second transfer of the color image onto the recording media, has a contact/shunt operation-switching mechanism for moving the transfer roller 7 into a non-contact state relative to the intermediate transfer device 2, by moving the transfer roller 7 to a predetermined shunting position during the color image-forming period, and for moving the transfer roller 7 into contact with the intermediate transfer device 2 after the color image has been formed on the intermediate transfer device 2.

Furthermore, this apparatus includes a current-detection means 5 for detecting current flowing from the power supply means 4 into the transfer roller 7; a transfer voltage-setting means 6 for adjusting the transfer voltage; and a transfer device state-determination means 8 for determining whether or not the transfer roller 7 is actually installed, or whether there is an anomaly in the attachment state of die transfer roller 7 and/or the contact/shunt operation-switching of the transfer 7 with respect to the intermediate transfer device 2, based on the detected current value. Here, although the above-described means 4, 5, 6, and 8 are actually located in the color image forming apparatus, they are not shown as such in this figure.

In a color image forming apparatus, such as a printer, a copy machine, and so on, since components such as a transfer roller, an intermediate transfer device, a photoconductor, etc., have generally different life spans, respectively, they are detachably installed. Accordingly, when the transfer roller 7 has been replaced, it is desirable to confirm that it is properly installed by using the transfer device state-determination means 8.

First, the processes for forming a color image, which is formed by superimposing toner images of, for example, four colors, will be explained.

While moving continuously at a constant speed in the direction of the arrow "a" shown in FIG. 1, the photoconductor 1 is uniformly charged by a charger 10 and is then exposed in accordance with respective color image signals provided by a laser beam emitted from an exposure device 9. Consequently, electrostatic latent images corresponding to respective colors are formed in turn on the photoconductor 1. During the first rotation of the photoconductor 1, an electrostatic latent image corresponding to the color of a developing device 14 is formed on the photoconductor 1, and its toner image is developed by the developing device 14. This toner image formed on the photoconductor 1 is transferred onto the surface of the intermediate transfer device 2, which is in contact with the photoconductor 1 and is moved by this photoconductor 1, so that a toner image corresponding to the color of the developing device 14 is formed on the surface of the intermediate transfer device 2. Next, during the second rotation of the photoconductor 1, an electrostatic latent image corresponding to the color of a developing device 13 is formed on the photoconductor 1. This toner image is developed by the developing device 13 and is transferred onto the surface of the intermediate transfer device 2. In the same manner, during the third and fourth rotations, corresponding toner images are developed by developing devices 12 and 11, respectively, and are transferred onto the surface of the intermediate transfer device 2 in order.

Although the colors set to the respective developing devices 14–11 are arbitrary, typical toners of cyan (C), magenta (M), yellow (Y), and black (B), are set to the respective developing devices in this embodiment. Also, the order of colors in the toner images to be developed is arbitrary. Moreover, while a color image is formed on the intermediate transfer device 2 by the above-described processes, the transfer roller 7 is put in a non-contact state relative to the intermediate transfer device 2, that is, at a shunt position, so as not to disturb the formation of the color image on the intermediate transfer device 2.

Each sheet of paper (not shown in FIG. 1) as a record medium, which is stored in a paper cassette 15, is picked up from the paper cassette 15 by a paper-feeding roller 16, and is transferred to the location of the transfer roller 7. In the image transfer operation, the transfer roller 7 is mechanically pressed against the intermediate transfer device 2 with a predetermined pressure, and it operates to transfer the color toner image formed on the intermediate transfer device 2 onto the paper in response to the application of a second transfer voltage from the power supply means 4.

The paper on which the color toner image has been transferred is peeled away from the intermediate transfer device 2 and is conveyed to a fixing device 17. Further, while the paper passes through the fixing device 17, the color toner image is thermally fixed on the surface of the paper. Then, the paper is finally discharged from the image forming apparatus.

In the color image-forming processes, if the voltage applied to the transfer roller 7 is fixed when a toner image is transferred from the intermediate transfer device 2 onto a record medium, since the print concentration in the color image changes depending on the temperature or humidity of the environment in which the image forming apparatus is placed, the second transfer voltage is corrected. In this correction, at the beginning of the color image-forming processes, the transfer roller 7 is pressed against the intermediate transfer device 2, while maintaining the level of the voltage output from the power supply means 4, and the current flowing between the transfer roller 7 and the intermediate transfer device 2 is detected by the current-detection means 5. Since the value of the detected current changes due to a change in the conditions of the environment around the image forming apparatus, the second transfer voltage is corrected based on the detected current, so as to keep the print concentration constant. Here, a table which expresses the relationship between the value of the detected current and the voltage to be applied to the transfer roller 7 is stored in the transfer device voltage-setting means 6, and the voltage output from the power supply means 4 is adjusted, based on the value of the detected current, using this table.

It should be noted that the voltage-setting means 6, the transfer device state-determination means 8, and the control means 19, which are shown in FIG. 1, can be incorporated into a one-chip microprocessor (CPU).

Next, the processes executed by the transfer device state-determination means 8, that is, to detect whether or not the transfer roller 7 is actually installed, or to detect an anomaly in the attachment state of the transfer roller 7 and/or the contact/shunt operation-switching of the transfer roller 7 with respect to the intermediate transfer device 2, will be explained with reference to FIG. 2.

Figure 2:
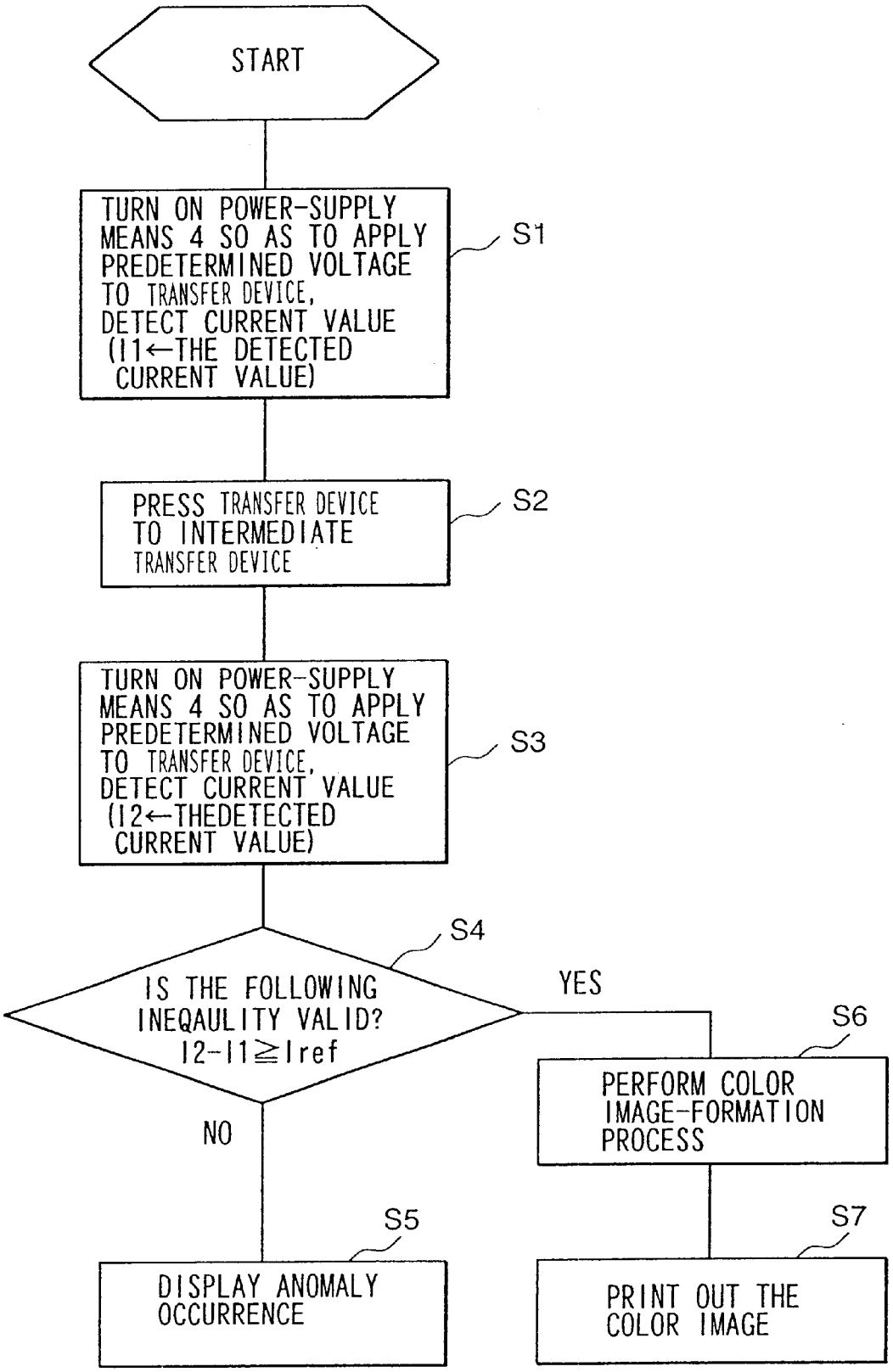
FIG. 2 is a flow chart showing an example of the process for determining the occurrence of an anomaly of a transfer device, which is executed in the embodiment.

FIG. 2 is a flow chart showing an example of the processes for determining the occurrence of an anomalous state of the transfer roller 7. First, when a signal requiring color image-formation is input to the image forming apparatus, in step S1, the power-supply means 4 is turned on, and a predetermined voltage V1 is applied to the transfer roller 7, which is in a non-contact state with respect to the intermediate transfer device 2, that is, it is spaced away from the intermediate transfer device 2. A first current value I1, which has been detected by the current-detection means 5, is stored in the transfer roller state-determination means 8, and the power-supply means 4 is turned off.

In step S2, the transfer roller 7 is pressed against the intermediate transcription device 2 by operating the contact/shunt operation-switching means of the transfer roller 7. Further, in step S3, the power-supply means 4 is turned on again, and the predetermined voltage V1 is applied to the transfer roller 7, which is now in contact with the intermediate transfer device 2. A second current value I2, which has been detected by the current-detection means 5, is stored in the transfer roller state-determination means 8, and the power-supply means 4 is turned off.

In step S4, the difference between the detected current values I1 and I2 is calculated by the transfer state-determination means 8, and if this difference is greater than a predetermined reference value Iref, it is determined that the transfer roller 7 is properly installed, and the switching between die contact and shunt operation of the transfer roller 7 also has been normally performed. Then, this determination result is transmitted to the control means 18, and the usual image-formation processing is started. Thus, the previously-described color image-formation processes are started, and a color image is printed on a record medium.

Conversely, if it is determined in step S4, that the current difference is less than the predetermined reference value Iref, it is considered that the transfer roller 7 is not installed or is improperly installed, or that an anomaly has occurred in the switching between the contact and shunt positions of the transfer roller 7. Then, the transfer state-determination means 8 informs the control means 18 that an anomalous state has occurred at the transfer roller 7. Further, when the control means 18 is informed of this condition, the occurrence of the anomaly concerning the transfer roller 7 is displayed on a display unit, which is not shown in the figures, or this information is transmitted to a host computer, which is also not shown in the figures. The user will be informed of the occurrence of die anomaly concerning the transfer roller 7 by the display.

Figure 3:
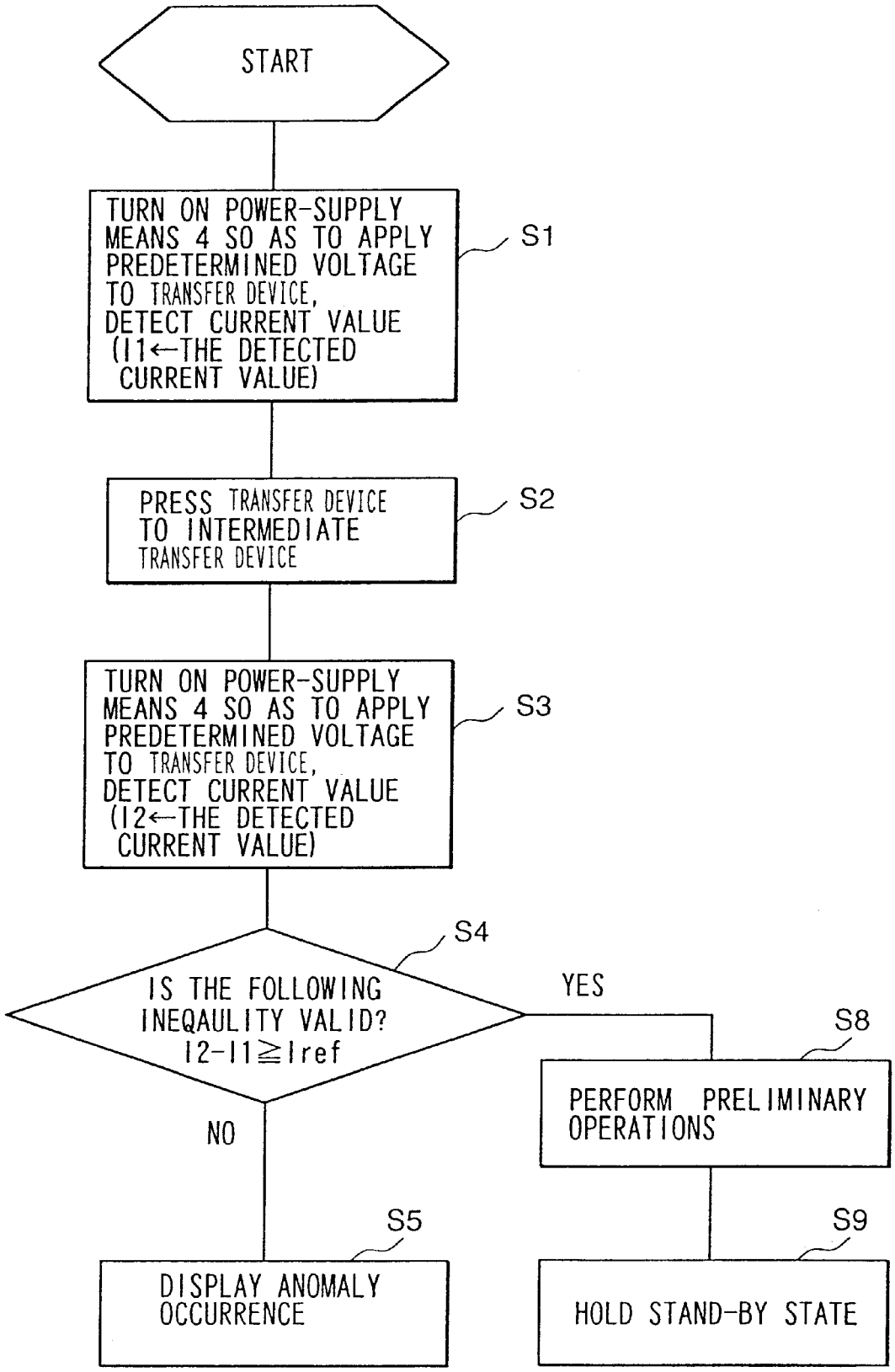

It is also possible to determine the state of the transfer roller when the image forming apparatus is switched. A flow chart of the processes for determining the occurrence of an anomaly concerning the transfer roller 7, which is executed in this case, is shown in FIG. 3. Note that the reference number of each step in the following description is that shown in FIG. 3.

After the power of the image forming apparatus is turned on, in step S1, the power-supply means 4 is turned on, and a predetermined voltage V1 is applied to the transfer roller 7 which is in a non-contact state with regard to the intermediate transfer device 2, that is, it is positioned away from the intermediate transfer device 2. The first current value I1, which has been detected by the current-detection means 5, is stored in the transfer state-determination means 8, and the power-supply means 4 is turned off.

In step S2, the transfer roller 7 is pressed against the intermediate transfer device 2 by operating the contact/shunt operation-switching means of the transfer roller 7. Further, in step S3, the power-supply means 4 is turned on again, and the predetermined voltage V1 is applied to the transfer roller 7, which is in contact with the intermediate transfer device 2. The second current value I2, which has been detected by the current-detection means 5, is stored in the transfer state-determination means 8, and the power-supply means 4 is turned off.

Then, in step S4, the difference between the detected current values I1 and I2 is calculated by the transfer state-determination means 8, and if this difference is greater than the predetermined reference value Iref, it is determined that the transfer roller 7 is properly installed, and the switching between the contact and shunt positions of the transfer roller 7 also has been normally performed. Then, this determination result is transmitted to the control means 18, and if another anomaly is not detected (this is not shown in FIG. 3), the process goes to step S8 in which preliminary operations for the image forming apparatus are performed, and then to step S9 in which the stand-by state of the image forming apparatus is established.

Conversely, if it is determined in step S4, that the current difference is less than the predetermined reference value Iref, it is considered that the transfer roller 7 is not installed or is improperly installed, or that an anomaly has occurred in the switching between the contact and shunt positions of the transfer roller 7. Then, the state-determination means 8 informs the control means 18 that an anomalous state has occurred at the transfer roller 7. Further, when the control means 18 is informed of this condition, the occurrence of the anomaly concerning the transfer roller 7 is displayed on a display unit, which is not shown in the figures, or this information is transmitted to a host computer, which is also not shown in the figures. The user will be informed about the occurrence of the anomaly concerning the transfer roller 7 by the display.

Figure 4:
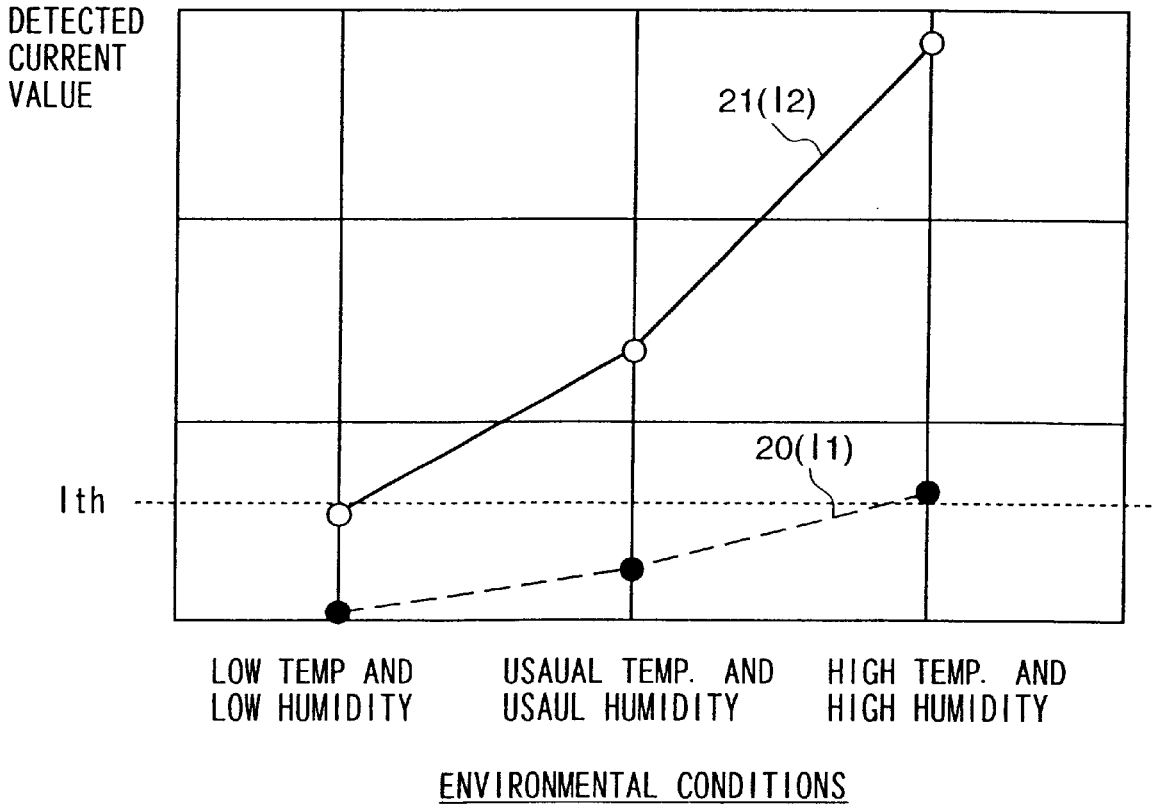
FIG. 4 is a graph showing the change in current characteristics of a transfer device due to the change in environmental conditions.

The reason why the difference between the first and second current values is used in step S4 in the processes for determining an anomaly occurring at the transfer roller 7, as shown in the flow charts in FIG. 2 and FIG. 3, will be explained below with reference to FIG. 4. This figure shows the change in the current characteristics of a transfer roller due to a change in environmental conditions. The abscissa indicates the respective environmental conditions, and the ordinate indicates the value of the current flowing into the transfer roller 7 when a predetermined voltage is applied to the transfer roller 7. Reference numbers 21 and 22 indicate the value I1 of the current flowing into the transfer roller 7, in the non-contact and contact states, respectively.

Here, I1 and I2 change due to a change in the environmental conditions. In the respective environmental conditions, I1<I2. However, I1 under the conditions of high temp. and high humidity>I2 under the conditions of low temp. and low humidity. Therefore, it is impossible to determine whether or not the transfer roller 7 is in contact with the intermediate transfer device 2 or is in the shunt position displaced from the intermediate transfer device 2, by detecting only the second current value and comparing it with a predetermined threshold value Ith. Here, the reference value Iref is set so that it satisfies the following inequality, and takes a value as large as possible, while taking errors in die detected current values into account.

$Iref<I2-I1$, at low temp. and low humidity.

Further, it is preferable to detect the respective first and second current values plural times and to obtain an average of current difference values with these first and second current values to be used as the reference value Iref, in order to reduce the influence of variation in the detected current value. This makes the determination of the state of the transfer roller more reliable.

Furthermore, it is also desirable to store each current difference value obtained at every determination of the state of the transfer roller, which has been determined to be normal, in a storage means, and to set or correct the reference value using a statistic value, such as an average, which is obtained by statistically processing the history of the stored current difference values, in order to set the reference value to a proper value adapted to the individual specificity of the image forming apparatus. This makes the determination of the state of the transfer roller more accurate.

As mentioned above, in accordance with the present invention, it has become possible to provide a color image-forming apparatus which can detect an anomalous attachment of the transfer roller, which is likely to occur, as well as an anomaly in the switching operation between the contact/shunt positions of the transfer roller.

Specifically, since the reliability of detecting whether or not a transfer roller is installed, or whether an anomaly in operation of the transfer roller is ensured even if the conditions of the environment in which a color image-forming apparatus is placed change, it is possible to prevent an erroneous detection of an anomaly, which in turn makes it possible to provide the color image-forming apparatus with die capability of highly accurate anomaly detection.

Moreover, since the current-detection means can be also used to determine the ordinary conditions of application of voltage to a transfer roller, it is possible to suppress an increase in the price of the color image-forming apparatus to a minimum.

What is claimed is:

1. An image forming apparatus comprising:

an image forming device on which toner images are formed;

a transfer device for transferring said toner images onto a record medium;

voltage-application means for applying a transfer voltage to said transfer device;

current-detection means for detecting current flowing between said image forming device and said transfer device;

storage means for storing a first current value detected when said transfer device is at a non-operation position, and a second current value detected when said transfer device is at an operation position; and transfer device state-determination means for determining the presence of said transfer device and an occurrence of an anomaly in a contact operation of said transfer device with said image forming device and a shunt operation of said transfer device to a shunt position away from said image forming device.

2. An image forming apparatus according to claim 1, further including a photoconductor on which electrostatic latent images are formed, and a development device for developing said latent images; wherein said image forming device is an intermediate transfer device onto which said images developed on said photoconductor are transferred.

3. An image forming apparatus according to claim 1, wherein said respective images formed on said photoconductor are developed with toners of different colors, and said images developed with said toners of different colors are superimposed on said intermediate transfer device.

4. An image forming apparatus according to claim 2, wherein said respective images formed on said photoconductor arc developed with toners of different colors, and said images developed with said toners of different colors are superimposed on said intermediate transfer device.

5. An image formation apparatus according to any one of claims 1–4, wherein said transfer device is moved in contact with and is separated from said intermediate transfer device, and said first current value, which is detected when said transfer device is at a position away from said intermediate transfer device, is stored in said storage means.

6. An image forming apparatus according to claim 1, wherein said transfer voltage applied to said transfer device by said voltage-application means is a constant voltage, a value of the constant voltage being variable.

7. An image forming apparatus according to claim 1, wherein said transfer device state-determination means effects determination in accordance with a relationship of the detected first current value and the detected second current value.

8. An image forming apparatus comprising:

an image forming device on which toner images are formed;

a transfer device for transferring said toner images onto a record medium;

voltage-application means for applying a transfer voltage to said transfer device;

current-detection means for detecting current flowing between said image forming device and said transfer device;

storage means for storing a first current value detected when said transfer device is at a non-operation position, and a second current value detected when said transfer device is at an operation position; and transfer device state-determination means for determining the presence of said transfer device and an occurrence of an anomaly in a contact operation of said transfer device with said image forming device and a shunt operation of said transfer device to a shunt position away from said image forming device;

wherein said transfer device is moved in contact with and is separated from said intermediate transfer device, and said first current value, which is detected when said transfer device is at a position away from said intermediate transfer device, is stored in said storage means; and wherein said second current value, which is detected after a control command signal operates to cause said transfer device to move in contact with said intermediate transfer device, is stored in said storage means, and said transfer device state-determination means determines the presence of said transfer device; and an occurrence of an anomaly in a contact operation of said transfer device with said image forming device, and in a shunt operation which moves said transfer device away from said image forming device, based on said stored first and second current values.

9. An image forming apparatus comprising:

an image forming device on which toner images are formed;

a transfer device for transferring said toner images onto a record medium;

voltage-application means for applying a transfer voltage to said transfer device;

current-detection means for detecting current flowing between said image forming device and said transfer device;

storage means for storing a first current value detected when said transfer device is at a non-operation position, and a second current value detected when said transfer device is at an operation position; and transfer device state-determination means for determining the presence of said transfer device and an occurrence of an anomaly in a contact operation of said transfer device with said image forming device and a shunt operation of said transfer device to a shunt position away from said image forming device;

wherein said transfer device is moved in contact with and is separated from said intermediate transfer device, and said first current value, which is detected when said transfer device is at a position away from said intermediate transfer device, is stored in said storage means; and wherein said determination executed by said transfer device state-determination means is performed by comparing a current difference between said first and second current values, with a predetermined reference value.

10. An image forming apparatus according to claim 9, wherein said respective first and second current values are detected multiple times, and an average of current difference values obtained with these first and second current values is used as said reference value.

11. An image forming apparatus according to claim 9, wherein each current difference value, obtained at every determination executed by said transfer device state-determination means, which has been determined to be normal, is stored in said storage means, and the reference value is set or corrected using a statistic value, which is obtained by statistically processing the history of said stored current difference values.

12. A color image-forming apparatus comprising:

a photoconductor on which electrostatic latent images are formed by charging and exposing said photoconductor, and toner images of said latent images are formed by developing said latent images;

an intermediate transfer device, which partially contacts said photoconductor, for receiving a first transfer of each of said toner images on said photoconductor, for each color, onto its surface while moving endlessly;

control means for controlling formation of a color image in which said toner images of plural colors are superimposed on said intermediate transfer device;

a transfer device for performing a second transfer of said color image onto a record medium;

a transfer device contact/shunt operations-switching mechanism for placing said transfer device in a non-contact state with respect to said intermediate transfer device by moving said transfer device to a predetermined shunt position away from said intermediate transfer device during a color image-formation period, and pressing said transfer device to said intermediate transfer device via a record medium after the completion of color image-formation;

power-supply means for changing and applying a transfer voltage to said transfer device when said color image is transferred from said intermediate transfer device onto said record medium;

current-detection means for detecting a current including first and second current values between said transfer device and said intermediate transfer device in accordance with a position of said transfer device;

transfer device voltage-setting means for setting up said transfer voltage based on said detected current; and transfer device state-determination means for determining the presence and attachment state of said transfer device, and an occurrence of an anomaly in a contact operation of said transfer device with said intermediate transfer device and in a shunt operation in which said transfer device is moved away from said intermediate transfer device, based on said detected first and second current values.

13. A color image-forming apparatus according to claim 12, wherein a first current value is detected by said current-detection means when said transfer device is pressed to said intermediate transfer device without the use of a record medium during an image non-transfer period of said transfer device, and a second current value is detected by said current-detection means in a non-contact state in which said transfer device is located at a predetermined position away from said intermediate transfer device.

14. A color image-forming apparatus according to claim 12, wherein said transfer voltage applied to said transfer device by said power-supply means as set by said transfer device voltage-setting means is a constant voltage, a value of the constant voltage being variable.

15. A color image-forming apparatus according to claim 12, wherein said transfer device state-determination means effects determination in accordance with a relationship of the detected first current value and the detected second current value.

16. A color image-forming apparatus comprising:

a photoconductor on which electrostatic latent images are formed by charging and exposing said photoconductor, and toner images of said latent images are formed by developing said latent images;

an intermediate transfer device, which partially contacts said photoconductor, for receiving a first transfer of each of said toner images on said photoconductor, for each color, onto its surface while moving endlessly;

control means for controlling formation of a color image in which said toner images of plural colors are superimposed on said intermediate transfer device;

a transfer device for performing a second transfer of said color image onto a record medium;

a transfer device contact/shunt operations-switching mechanism for placing said transfer device in a non-contact state with respect to said intermediate transfer device by moving said transfer device to a predetermined shunt position away from said intermediate transfer device during a color image-formation period, and pressing said transfer device to said intermediate transfer device via a record medium after the completion of color image-formation;

power-supply means for changing and applying a transfer voltage to said transfer device when said color image is transferred from said intermediate transfer device onto said record medium;

current-detection means for detecting a current including first and second current values between said transfer device and said intermediate transfer device in accordance with a position of said transfer device;

transfer device voltage-setting means for setting up said transfer voltage based on said detected current; and transfer device state-determination means for determining the presence and attachment state of said transfer device, and an occurrence of an anomaly in a contact operation of said transfer device with said intermediate transfer device and in a shunt operation in which said transfer device is moved away from said intermediate transfer device, based on said detected first and second current values;

wherein a first current value is detected by said current-detection means when said transfer device is pressed to said intermediate transfer device without the use of a record medium during an image non-transfer period of said transfer device, and a second current value is detected by said current-detection means in a non-contact state in which said transfer device is located at a predetermined position away from said intermediate transfer device; and wherein said transfer device state-detection means determines the presence and attachment state of said transfer device, and an occurrence of an anomaly in a contact operation of said transfer device with said intermediate transfer device and in a shunt operation which moves said transfer device away from said intermediate transfer device, based on a current difference between said first and second current values.

17. A method of determining an anomalous state of a transfer device in an image forming apparatus including an image forming device on which toner images are formed, a transfer device for transferring said toner images onto a record medium, voltage-application means for applying transfer voltage to said transfer device, current-detection means for detecting current flowing between said image forming device and said transfer device, and storage means for storing values of said detected current, said method comprising the steps of:

applying a predetermined voltage to said transfer device after it is confirmed that a command signal for operating said image forming apparatus has been output;

detecting a first current flowing between said transfer device and said image forming device at least one time;

storing a value of said detected first current in said storage means;

pressing said transfer device to said image forming device;

detecting a second current flowing between said transfer device and said image forming device at least one time;

storing a value of said detected second current in said storage means;

calculating a difference between said values of said detected first current and second current;

comparing said difference with a predetermined reference value; and determining that said transfer device is in an anomalous state, if said difference is smaller than said predetermined reference value.

18. A method according to claim 17, wherein said respective first and second current values are detected plural times, and an average of current difference values obtained with these first and second current values is used as said reference value.

19. A method according to claim 17, wherein each current difference value obtained at every determination executed by said transfer device state-determination means, which has been determined to be normal, is stored in said storage means, and the reference value is set or corrected using a statistic value, which is obtained by statistically processing the history of said stored current difference values.

* * * * *